US005586649A

United States Patent [19]

Hsiao

[11] Patent Number: 5,586,649

[45] Date of Patent: Dec. 24, 1996

[54] WHEEL RETAINING DEVICE

[75] Inventor: Louis Hsiao, Palo Alto, Calif.

[73] Assignee: Concept Designs, Inc., Mountain View, Calif.

[21] Appl. No.: 444,308

[22] Filed: May 18, 1995

[51] Int. Cl.[6] ..... B65D 85/02

[52] U.S. Cl. ..... 206/303; 211/20

[58] Field of Search ..... 206/303, 304, 206/304.1, 304.2; 211/19, 20, 23, 24, 49.1

[56] References Cited

U.S. PATENT DOCUMENTS

| | | | |
|---|---|---|---|
| 444,328 | 1/1891 | Boss . | |
| 536,445 | 3/1895 | Rockwell . | |
| 1,190,152 | 7/1916 | Gross . | |
| 1,225,952 | 5/1917 | Hamilton . | |
| 1,277,211 | 8/1918 | Graham . | |
| 1,419,871 | 6/1922 | McDonald . | |
| 1,486,983 | 3/1924 | McDonald . | |
| 1,508,239 | 9/1924 | O'Brien . | |
| 1,527,386 | 2/1925 | Barnard | 206/303 X |
| 1,561,201 | 11/1925 | Wocel . | |
| 1,620,148 | 3/1927 | Williams . | |
| 1,909,429 | 5/1933 | Sherman . | |
| 2,001,475 | 5/1935 | Vogt . | |
| 2,103,684 | 12/1937 | Long | 220/475 X |
| 2,626,062 | 1/1953 | Manzella . | |
| 2,882,170 | 4/1959 | Stewart | 206/303 X |
| 2,928,540 | 3/1960 | Cunningham . | |
| 3,093,149 | 6/1963 | Jaffee . | |
| 3,127,018 | 3/1964 | McMasters . | |
| 3,139,986 | 7/1964 | Strock . | |
| 3,265,224 | 8/1966 | Skubic . | |
| 3,280,987 | 10/1966 | Steinbock | 206/303 X |
| 3,378,183 | 4/1968 | Ferrer | 211/49.1 X |
| 3,472,466 | 10/1969 | Rutschi . | |
| 3,547,258 | 12/1970 | Black | 211/23 X |
| 4,573,587 | 3/1986 | Matthews, Jr. | 211/23 X |
| 5,503,277 | 4/1996 | O'Brien . | |

*Primary Examiner*—Jimmy G. Foster
*Attorney, Agent, or Firm*—Flehr, Hohbach, Test, Albritton & Herbert

[57] ABSTRACT

A wheel retaining device for retaining a plurality of replacement wheels. The wheel retaining device includes an elongate body dimensioned for insertion through apertures formed in the wheels and a retainer positioned proximate at least one of the opposite ends of the elongate body for retaining the wheels on the elongate body. The wheel retaining device further includes a display member for supporting the elongate body on a display.

20 Claims, 7 Drawing Sheets

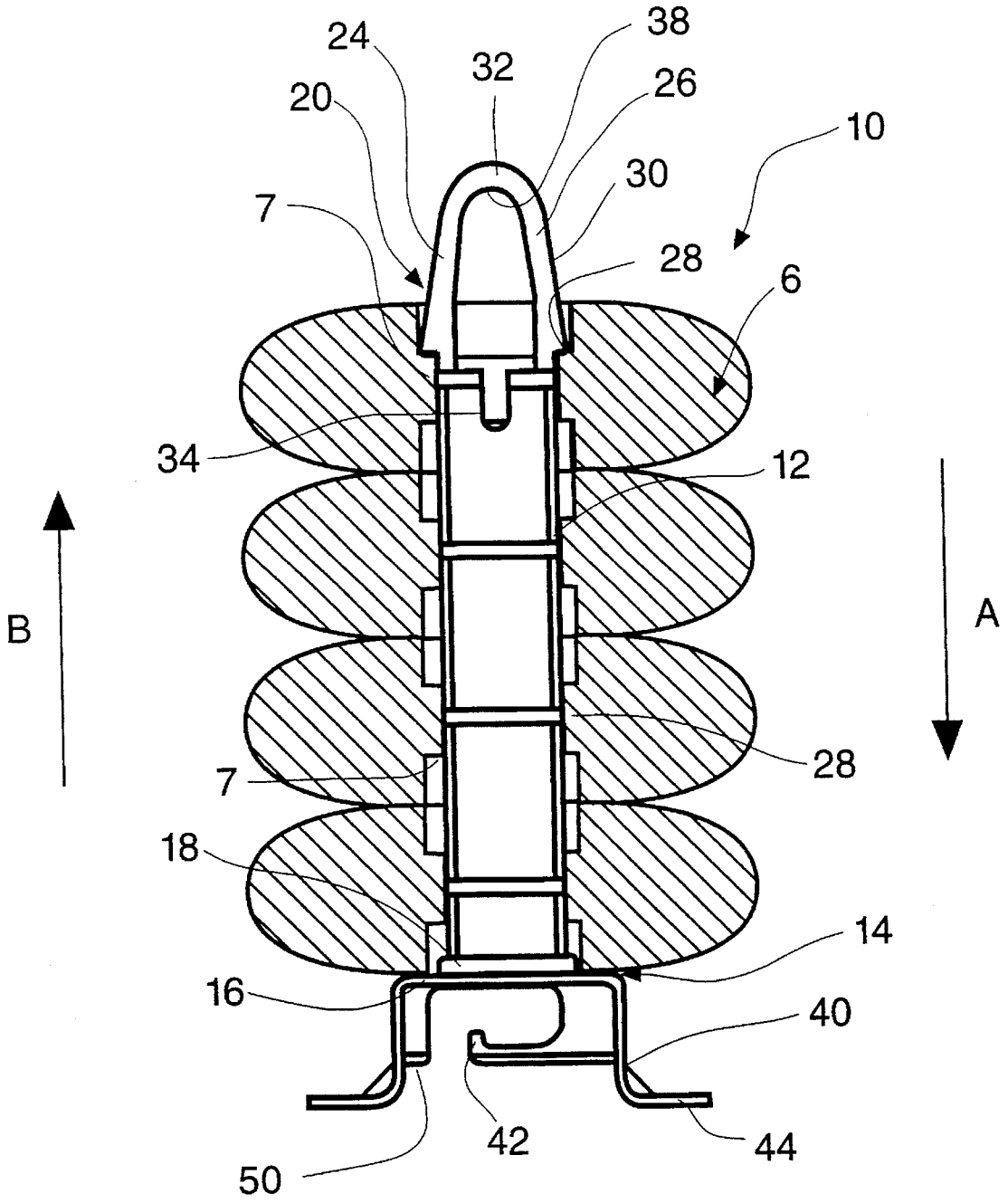
FIG.__ 1

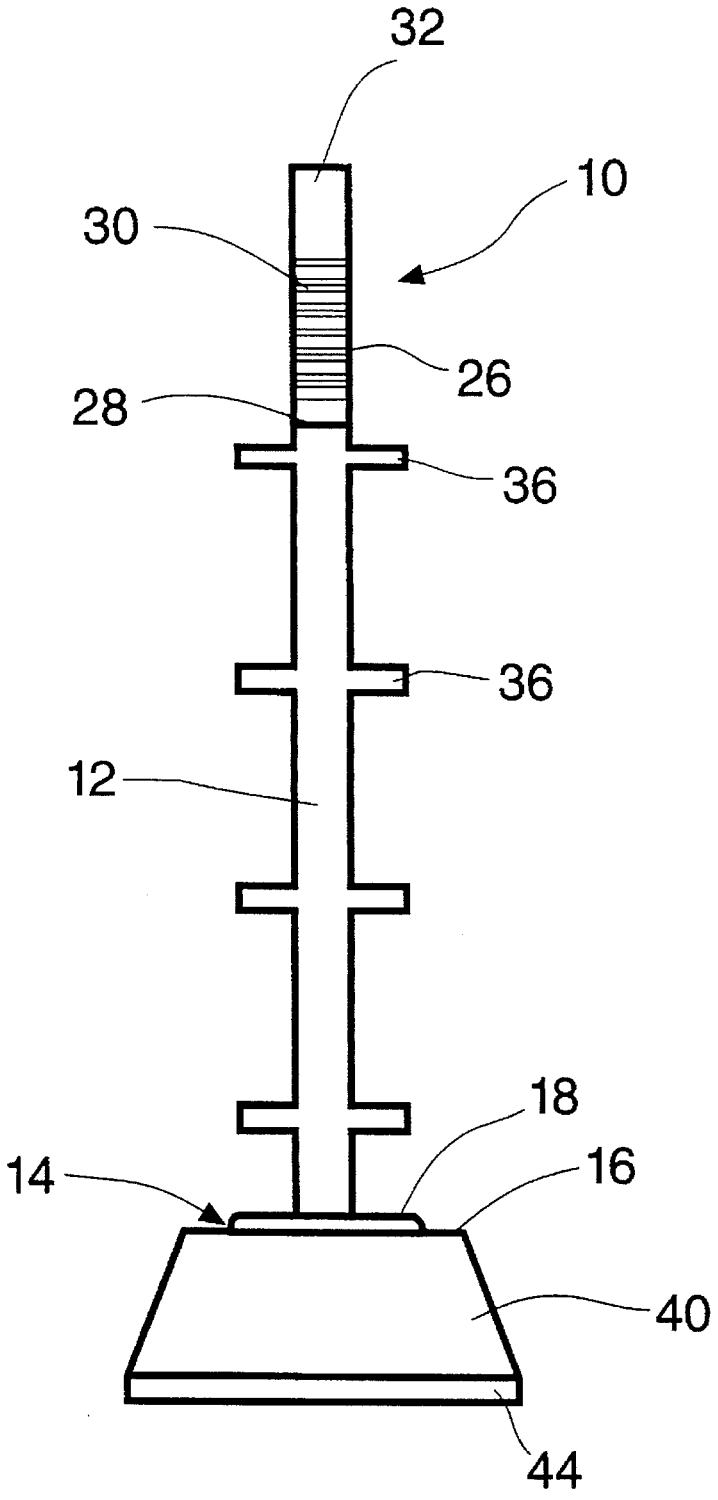
FIG.__ 2

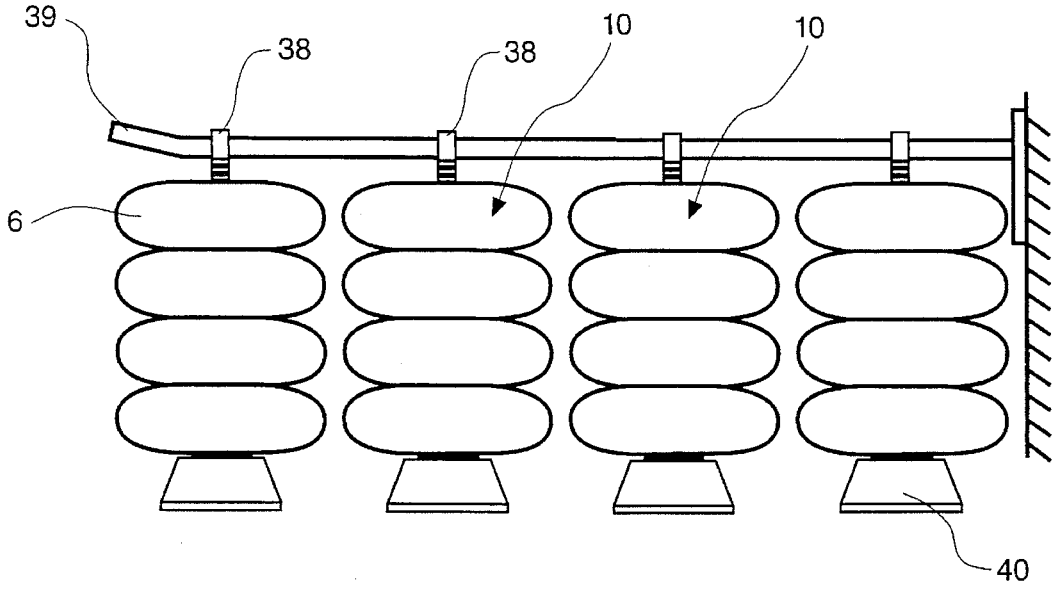
FIG.__ 3
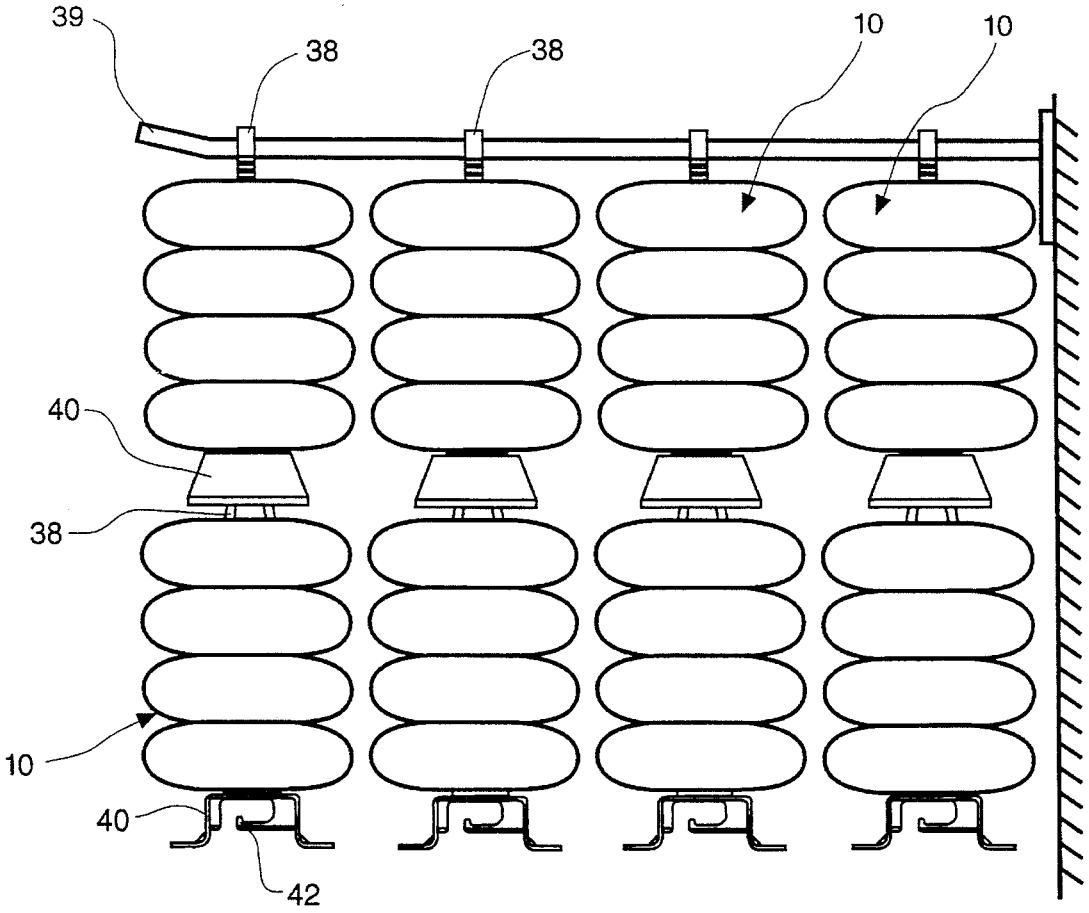
FIG.__ 4

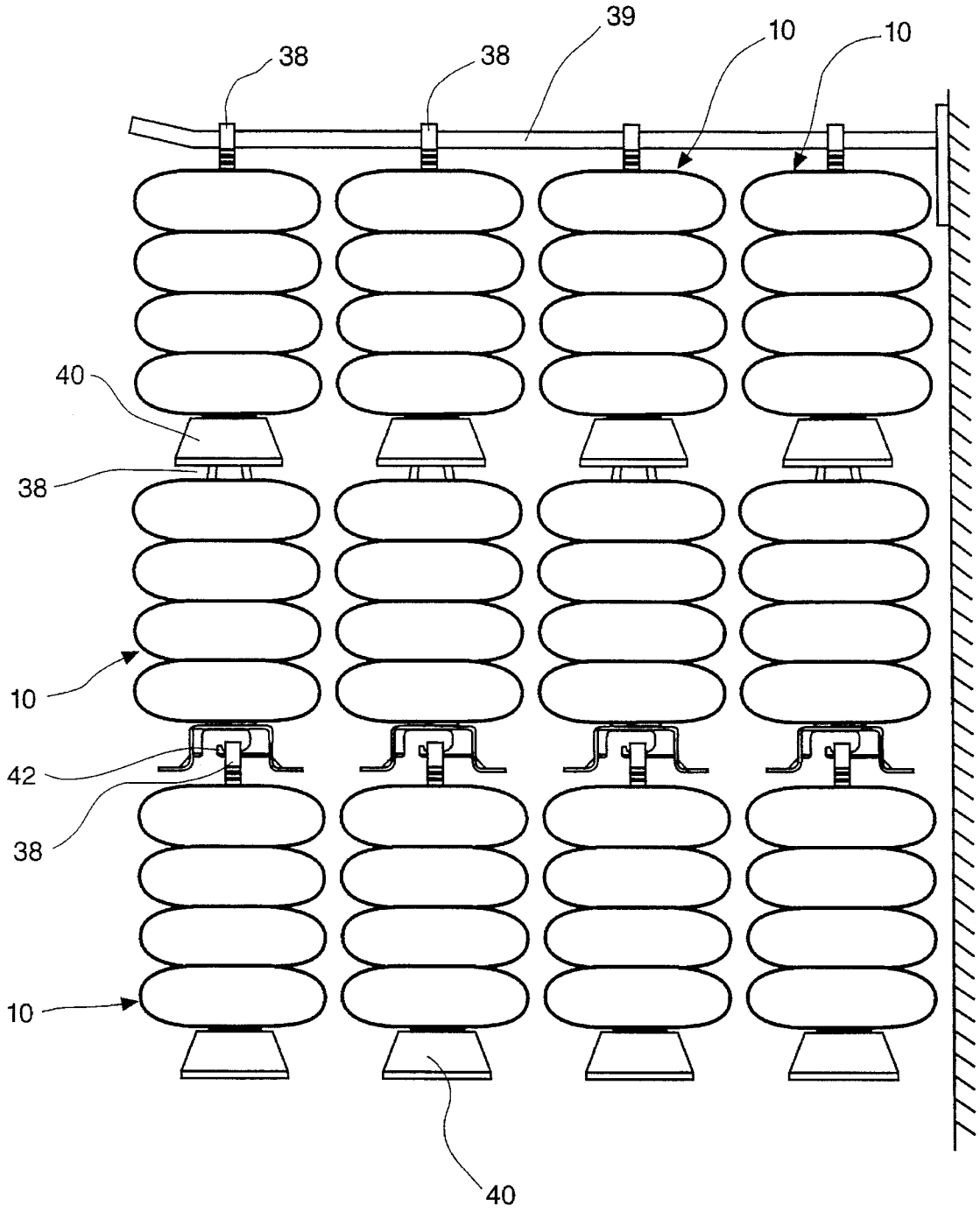
FIG.__ 5

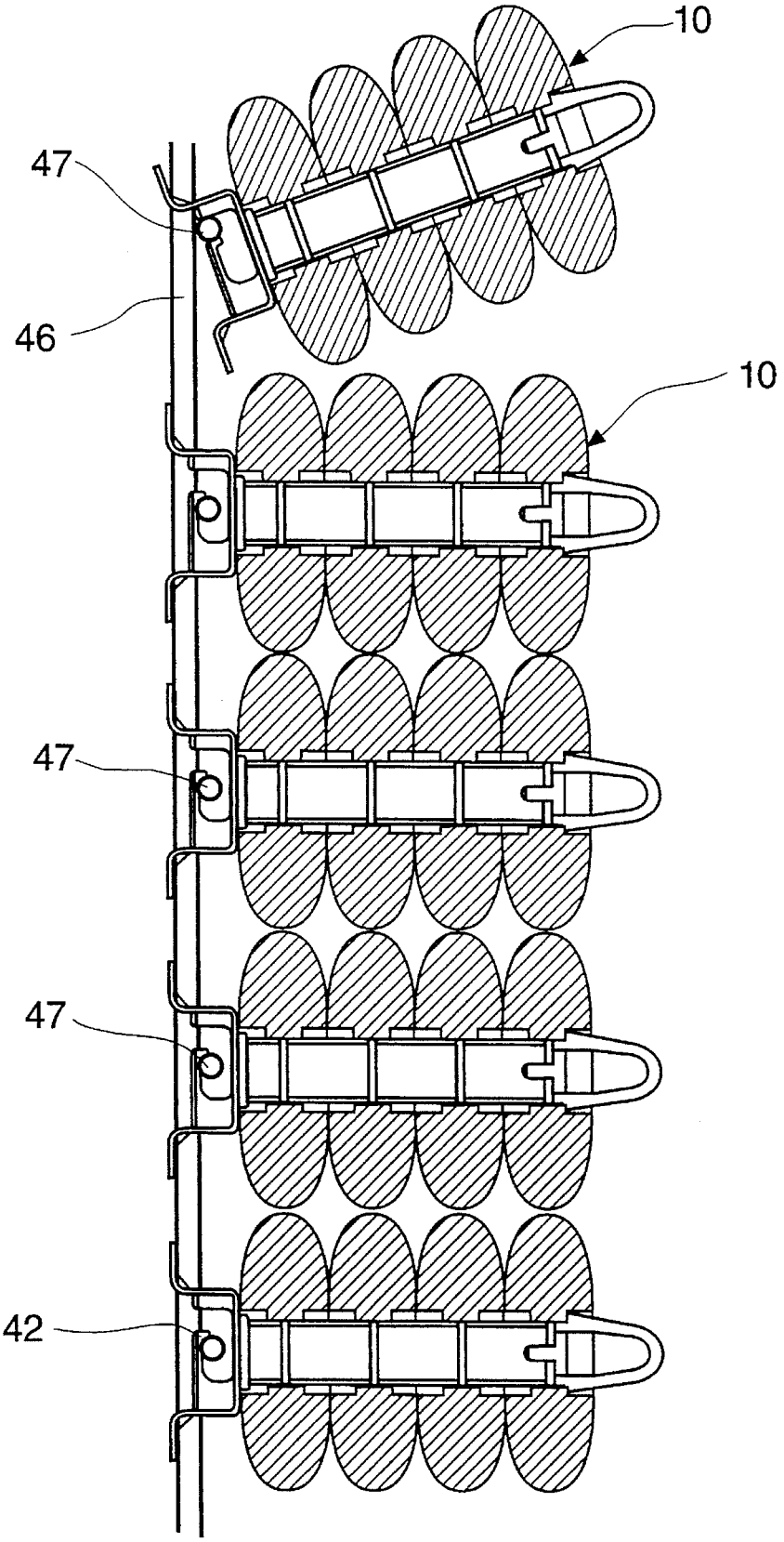
FIG.__ 6

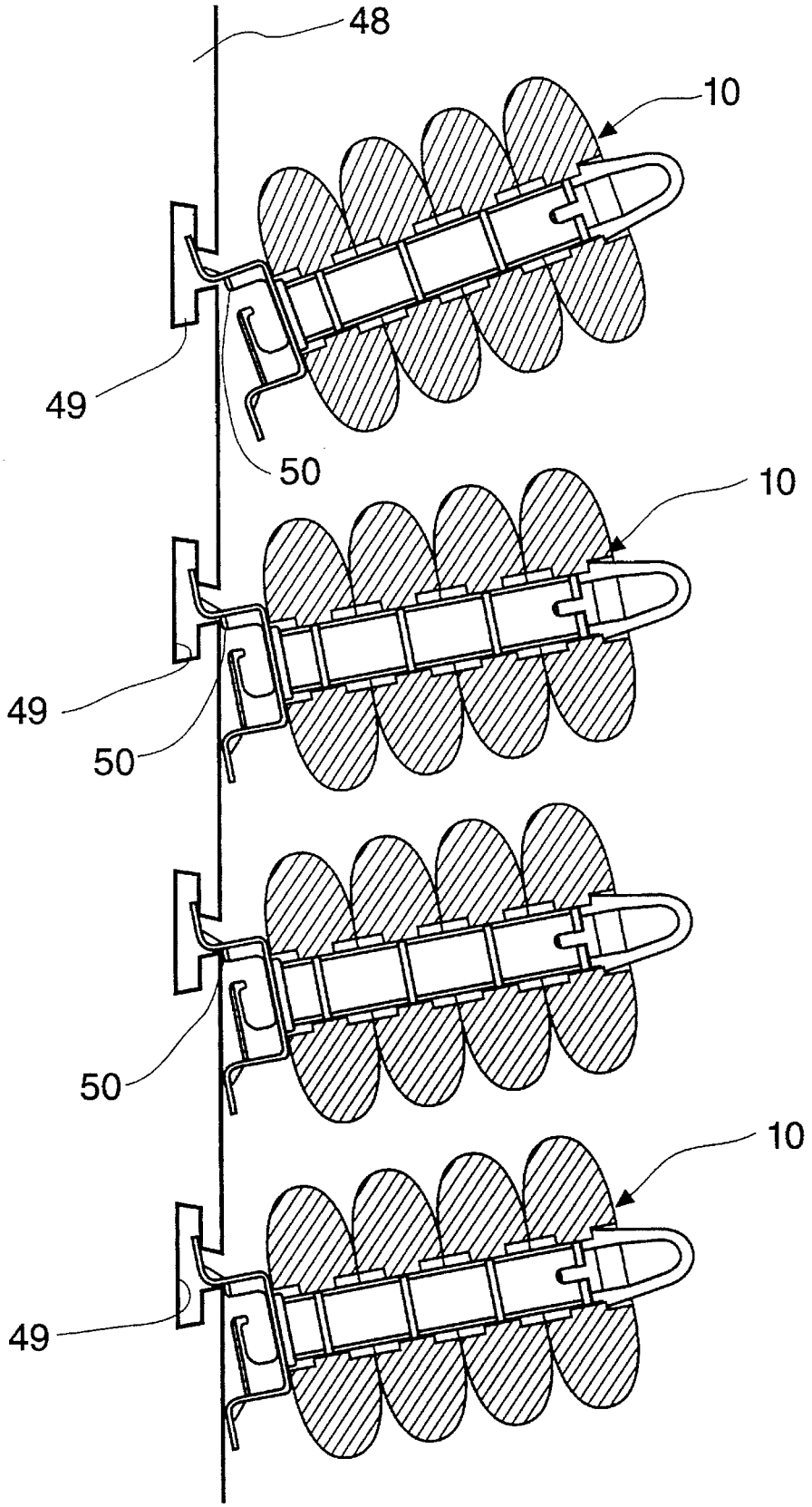
FIG.__ 7

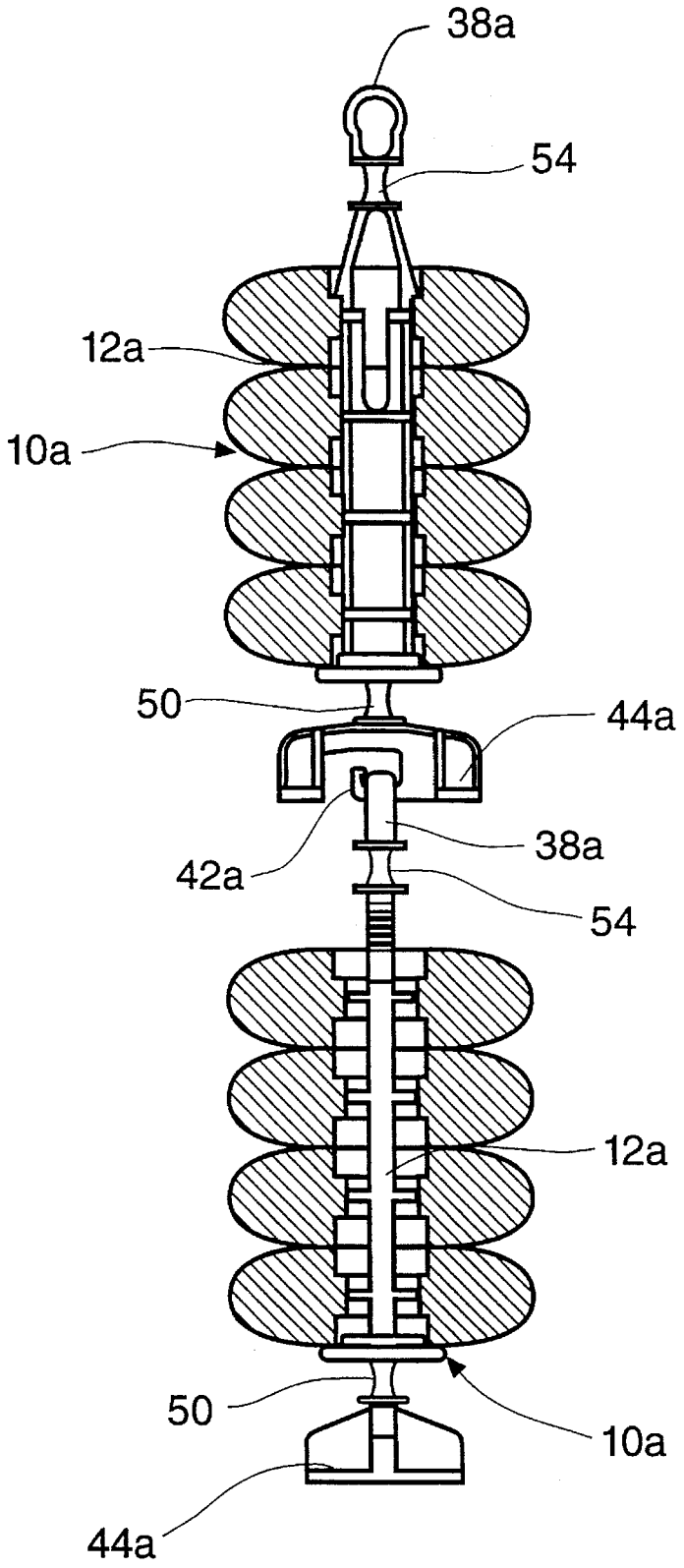
FIG.__ 8

WHEEL RETAINING DEVICE

BACKGROUND OF THE INVENTION

1. Field of the Invention.

This invention relates to a new and improved device for retaining wheels. More particularly, the present invention relates to a wheel retaining system for efficiently packaging a set of wheels.

2. Prior Art.

A user may wish to replace the wheels of his in-line skates, roller skates, skateboard and the like for numerous reasons including for example replacing worn wheels, upgrading to a higher quality wheel or selecting a wheel which is more suited for a particular activity. Replacement wheels are often supplied to the merchant in bulk form, with the merchant displaying a large quantity of wheels in an open container from which the consumer may retrieve the desired number of replacement wheels. Supplying the wheels in bulk requires minimal packaging efforts on the part of the wheel manufacturer. However, displaying loose wheels in an aesthetically appealing and ordered manner may be inconvenient and difficult for the merchant. Similarly, the consumer may find selecting and individually purchasing several wheels inconvenient and time consuming. Moreover, a consumer may unfairly assume that the bulk wheels are of a lesser quality than those sold in packages.

Replacement wheels are available in sets packaged in plastic clamshell-type packages. The clamshell packages, which typically hold a set of four wheels, are easier to display and market than the loose wheels. However, the packaging increases the cost of the wheels and disposing of the excess materials employed in the clamshell packages raises environmental issues.

This invention provides a new and improved system for packaging replacement wheels. The retaining device securely holds a plurality of wheels. The replacement wheels may be easily positioned on the retaining device and securely retained in place until they are removed by pulling the wheels from the device. The wheel retaining device is configured for conveniently displaying the retaining device.

SUMMARY OF THE INVENTION

The wheel retaining device of the present invention is particularly suitable for packaging a set of replacement wheels for in-line skates, roller skates, skate boards and the like. The wheel retaining device includes an elongate body which has spaced first and second ends and is dimensioned for insertion through the holes formed in the wheels. A retainer positioned proximate at least one of the ends of the elongate body holds the wheels on the elongate body. The wheel retaining device also may include a display structure for supporting the wheel retaining device on a display.

In one modification of the invention, a first retainer positioned at one of the ends of the elongate body securely supports the wheels on the elongate body. A second retainer spaced from the first retainer is configured so that the wheels may be positioned on the elongate body by sliding the wheels across the second retainer with minimal force. Once the wheels are positioned on the elongate body, the second retainer holds the wheels in place during shipment, handling and storage of the filled wheel retaining device. When a consumer wishes to use the replacement wheels, the wheels may be removed from the elongate body by pulling the wheels past the second retainer.

BRIEF DESCRIPTION OF THE DRAWINGS

The accompanying drawings, which are incorporated in and form a part of this specification, illustrate embodiments of the invention and, together with the description, serve to explain the principles of the invention:

FIG. 1 is a front plan view of a wheel retaining device in accordance with the invention.

FIG. 2 is a side plan view of the wheel retaining device of FIG. 1.

FIGS. 3–5 are side plan views showing several wheel retaining devices as displayed using display rods.

FIG. 6 is a side plan view showing several retaining devices as displayed on a grid wall display.

FIG. 7 is a side plan view showing several retaining devices as displayed on a slat wall display.

FIG. 8 is a front elevational view of another embodiment of a wheel retaining device.

DETAILED DESCRIPTION OF THE PREFERRED EMBODIMENTS

Reference is now made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

A wheel retaining device 10 retaining a plurality of replacement wheels 6 is shown particularly in FIGS. 1 and 2. The wheel retaining device of the invention may be used to hold a variety of wheels including wheels for in-line skates, roller skates, skate boards and the like. In the specification and claims, the term wheels is used to refer to the entire wheel assembly as well as the individual components of a wheel assembly such as the hub, tire, etc. By way of example, retaining device 10 is shown retaining elliptical-shaped rollers of the type used in in-line skates. The wheels 6 are formed with an aperture 7 extending through the body of the wheel and an interior hub 8 shaped to receive the skate axle. In the illustrated embodiment, the wheel retaining device holds four such wheels, the number of replacement wheels typically required for one skate. However, wheel retaining device 10 may be adapted to retain any number of wheels as desired.

Wheel retaining device 10 has an elongate body portion 12 shaped to hold a plurality of wheels 6 with the elongate body portion extending through the apertures 7 in the wheels and a first retainer 16 positioned proximate the lower end of the elongate body portion for supporting wheels 6 on the body portion 12. In the illustrated embodiment, the first retainer 14 comprises a support flange 16 extending outwardly from the elongate body portion 12 to engage a portion of the lowermost wheel 6 surrounding the aperture 7. Preferably, the flange 16 extends around the entire circumference of the elongate body portion 12. However, it is to be understood that in other modifications of the invention the first retainer 14 may include one or more flange segments which extend less than 360° of the circumference of the elongate body 12. As shown particularly in FIGS. 1 and 2, the first retainer 14 further includes a retaining plug 18 extending outwardly from the elongate body adjacent the upper surface of the support flange 16. The retaining plug 18 engages the aperture 7 in the lowermost wheel to provide additional stability in retaining the wheels 6 on the elongate body portion 12 of the retaining device. The first retainer 14 preferably includes both a support flange 16 and retaining plug 18 as shown in FIGS. 1 and 2, although in other modifications of the invention either the support flange or retaining plug may be eliminated.

Wheel retaining device 10 preferably includes a second retainer 20 proximate the upper end of the elongate body portion 12 for holding the wheels 6 on the elongate body. In the illustrated embodiment, second retainer 20 is shaped so that the wheels may be slipped across the second retainer 20 to position the wheels on or remove the wheels from the elongate body 12 so that the elongate body portion 12, first retainer 14 and second retainer 20 may be monolithically formed as a single unit. Preferably, minimal force is required to slip the wheels across the second retainer 20 and onto the elongate body 12. The second retainer 20 substantially resists forces applied during handling of the filled retaining device to hold the wheels 6 on the elongate body portion 12. The wheels 6 may be removed by pulling the wheels over the second retainer 20, applying sufficient force to overcome the resistance of the retainer 20.

In the illustrated embodiment, the second retainer 20 includes a pair of spaced, longitudinally extending arms 24 and 26. The arms 24 and 26 each have an outward extending shoulder 28 facing the elongate body portion and an inclined surface 30 extending upwardly and inwardly from the outer edge of the shoulder 28 to a transversely extending stretch 32 joining the distal ends of the longitudinally extending arms 24 and 26 together. Coupling the distal ends of arms 24 and 26 together offers several advantages, including strengthening the second retainer 20 and providing a loop which may be used to display the wheel retaining device 10. However, in other modifications of the invention the distal ends of the arms may be separate.

The arms 24 and 26 are resiliently deformable in an inward direction to permit passage of the wheels 6 past the second retainer 20. As the wheels are moved in the direction of arrow A (FIG. 1), the minimal force applied to the inclined surfaces 30 by the wheels deforms the arms 24 and 26 inwardly to permit passage of the wheels past the second retainer 20. Movement of the wheels 6 in the direction of arrow B is initially resisted by the outward extending shoulders 28. The shoulders 28 resist movement of the wheels in the direction of arrow B, retaining the wheels on the elongate body 12 during storage, shipment and handling of the wheel retaining device 10. The wheels may be removed from the elongate body 12 by pulling the wheels with sufficient force to overcome the resistance of shoulders 28 and deform the arms inwardly to permit passage of the wheels past the second retainer 20. Alternatively, the consumer may deform the arms inwardly while moving the wheels in the direction of arrow B.

One advantage of the second retainer 20 of the illustrated embodiment is that it permits passage of the wheels past the second retainer when the wheels are moved onto or removed from the elongate body 12. The second retainer 20 also holds the wheels 6 together, preventing slippage of the wheels along the elongate body. Moving the wheels across the second retainer to fill the elongate body with wheels and remove wheels from the elongate body minimizes the operational steps employed during the packaging of the wheels on the wheel retaining device 10. However, if desired, the wheel retaining device of the invention may be provided with a retainer which is permanently or removably mounted to the retaining device 10 after the elongate body has been filled with wheels. Instead of securely holding the wheels together as is shown in FIG. 1, the second retainer 20 may be configured so that it merely prevents the wheels from being separated from the elongate body 12 during handling of the retaining device 10.

In the preferred form of the invention, wheel retaining device 10 includes both a first retainer 14 and a second retainer 20. However, it will be understood that in other modifications of the invention the wheel retaining device may include only one retainer.

As shown in FIG. 1, the elongate body 12 preferably has a slot 34 extending inwardly into the elongate body 12 from the second retainer 20. The slot 34 facilitates the inward deformation of the arms 24 and 26 for movement of the wheels 6 past the second retainer 18. The length of the slot 34 is subject to variation depending upon such factors as the material employed, the length of arms 24 and 26, the slope of the inclined surfaces 30 and the shoulders 28, and the like. Moreover, the slots 34 may be omitted if desired.

The wheel retaining device 10 of the illustrated embodiment includes tabs or projections 36 extending outwardly from the elongate body portion 12 to engage the interior hubs 8 of the wheels. The tabs 36 provide additional stability, preventing slippage of the wheels along the elongate body and holding each wheel in place. When fewer than the maximum number of wheels are positioned on the elongate body, the tabs 36 prevent the wheels from sliding along the elongate body portion to more securely retain the wheels on the wheel retaining device 10. A user may easily disengage the wheel from the tabs 36 by manually pulling the wheel along the elongate body portion. In other embodiments of the invention, tabs 36 may be omitted if desired.

The wheel retaining device 10 of the present invention preferably includes means for conveniently displaying the wheel retaining device. One such display means is provided by the loop 38 formed by the arms 24 and 26 and the transversely extending stretch 32. The loop 38 may be used to suspend the wheel retaining device from a rod 39 (FIG. 3), peg and the like to display the wheel retaining device. The loop 38 is subject to considerably variation. Instead of a loop, the retaining arms 24 and 26 may be formed in the shape of a hook which may be used to display the retaining device 10. Alternatively, loop 38 may be provided by an element separate from the second retainer 20.

In the illustrated embodiment, wheel retaining device also includes a display base 40 configured for mounted the retaining device 10 to various types of display structures. The underside of the display base 40 includes a connector retaining hook 42. As is shown in FIGS. 4 and 5, retaining hook 42 is shaped to engage the loop 38 of a second retaining device to link two or, note wheel retaining devices together, with the of the uppermost device 10 supporting the wheel retaining devices on a display rod 39. Coupling two wheel retaining devices together allows the consumer to conveniently purchase replacement wheels for both skates when only four wheels are retained on each device 10. The consumer may easily separate the linked devices when he desires to purchase a single wheel retaining device. Moreover, the wheel retaining devices may be displayed by linking more than two wheel retaining devices if desired. Instead of coupling two wheel retaining devices together, retaining hook 42 may be used to releasably secure the device 10 to a display apparatus, vertical display rack or other types of displays as is known in the art.

Display base 40 further includes a pair of outward extending legs 44. Legs 44 may be used to support wheel retaining device 10 in an upright position on a surface such as a counter, display shelf or the like for displaying the device. The consumer may stand the wheel retaining device on legs 44 to store the device after purchase until the replacement wheels are needed. Instead of two legs as shown in the present embodiment, wheel retaining device may have a greater number of legs or one leg extending circumferentially around the base 40. The display base 40 of the present embodiment is configured so that base 40 may be used to secure the wheel retaining device to a display apparatus, vertical display rack such as a grid wall (FIG. 6) or slat wall (FIG. 7) type of display or other types of displays as is known in the art. As is shown in FIG. 6, the wheel retaining device 10 may be mounted to a grid wall display 46 by positioning the device with the retaining hook 42 engaging rod 47 and the legs 44 engaging the wall. The wheel retaining device 10 is mounted to a slot wall display 48 by inserting one of the legs 44 of the display base into a slot 49 and allowing flange 50 and the other leg 44 of the display base 40 to rest against the wall beneath the slot. Although FIG. 7 shows a slot wall display having T-shaped slots, it will be understood that other shapes such as L-shaped slots may also be used.

Providing wheel retaining device 10 with a loop 38, retaining hook 42 and support legs 44 provides the merchant with several options of displaying the wheel retaining device. However, if desired, wheel retaining device may be formed with one or an alternate combination of the display means shown in FIGS. 1 and 2.

In the embodiment of the invention shown in FIG. 8, wheel retaining device 10*a* includes a loop 38*a* spaced from the second retainer 20*a*, a retaining hook 42*a*, and legs 44*a*. Retaining device 10*a* further includes a pair of axles 54 positioned on opposite ends of the elongate body portion 12*a*. The wheel retaining device 10*a* is particularly suitable for use with a display apparatus (not shown) of the type which holds a plurality of objects and individually dispenses the objects through an opening at the lower end of the display, with the products held in the device moving closer to the lower opening each time a product is removed. Axles 54 are shaped to ride along the side rails of the display apparatus with the retaining devices having a generally horizontal orientation instead of the vertical orientation shown in FIG. 8, the axles 54 supporting the wheel retaining devices as the devices move downwardly through the display when a device is removed from the lower end of the display rack.

Except as set forth above, the modification of FIG. 8 resembles those of the preceding modification and the same reference numerals followed by the subscripts a are used to designate corresponding parts.

As is apparent from the foregoing, this invention provides a wheel retaining device for conveniently and efficiently holding a plurality of wheels. The wheels may be easily slipped past the second retainer and positioned on the elongate body of the retaining device. The first and second retainers securely retain the wheels on the device during storage, handling and shipment of the wheel retaining device. The display structure employed in the various modifications of the invention provide a means for conveniently and efficiently displaying and attractively marketing a plurality of wheel retaining devices for purchase by a consumer.

The foregoing descriptions of specific embodiments of this invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A package comprising a wheel retaining device and a plurality of wheels each having an aperture formed therein, said wheel retaining device comprising:

an elongate body extending through said apertures in said wheels, said elongate body having first and second ends;

a first retainer positioned proximate one of said ends of said elongate body for supporting said wheels on said elongate body, a second retainers paced from said first retainer, said second retainer substantially resisting removal of said wheels from said elongate body over said second retainer to securely retain said wheels on said elongate body (luring handling of said wheel retaining device.

2. The package of claim 1 in which said second retainer permits movement of said wheels past said second retainer for removal of said wheels from said elongate body upon application a force greater than a predetermined force, said second retainer substantially resisting removal of said wheels from said elongate body upon application of a force less than said predetermined force.

3. The package of claim 1 in which said second retainer comprises a pair of opposed arm portions, said arm portions each having an outward extending shoulder extending outwardly from said elongate body and an inclined surface extending inwardly from said shoulder, said inclined surface being shaped to facilitate movement of said wheels past said arms onto said elongate body and said shoulder being shaped to resist removal of said wheels from said elongate body.

4. The package of claim 1 in which said second retainer includes a pair of spaced, resilient arm portions, said arm portions being deformable in an inward direction when said wheels are moved past said arm portions to position said wheels on said elongate body and to remove said wheels from said elongate body.

5. The package of claim 4 in which said elongate body has a longitudinally extending slot formed therein, said slot facilitating deformation of said arm portions for movement of said wheels past said second retainer.

6. The package of claim 1 in which said first retainer includes a flange extending outwardly from said elongate body, said flange engaging one of said wheels to support said wheels on said elongate body.

7. The package of claim 1 in which said first retainer includes a plug engaging said aperture of one of said wheels when said wheels are positioned on said elongate body.

8. The package of claim 1 in which said elongate body includes at least one projection engaging the inner wall of said aperture of at least one of said wheels when said wheels are positioned on said elongate body.

9. The package of claim 1, and further comprising display means for displaying said wheel retaining device.

10. The package of claim 1, further in which said wheel retaining device includes spaced first and second axles each positioned proximate one of said ends of said elongate body, said axles being configured for supporting said device in a display apparatus having spaced side rails and a lower opening for dispensing said device from said display, each of said axles being shaped and positioned to ride along one of said side rails as said device moves toward said lower opening.

11. The package of claim 1 in which said second retainer is integral with said elongate body, said second retainer being shaped for movement of said wheels over said second retainer to position said wheels on said elongate body.

12. In combination, a wheel retaining device and a plurality of wheels each having an aperture formed therein, said wheel retaining device comprising:

an elongate body extending through said apertures in said wheels, said elongate body having opposed ends;

a retainer positioned at one of said opposed ends of said elongate body, said retainer substantially resisting removal of said wheels from said elongate body for retaining said wheels on said elongate body, said retainer being integral with said elongate body and configured to permit said wheels to slip over said retainer when said wheels are moved onto said elongate body; and a base portion positioned at tile other of said ends, said base portion being configured for selectively supporting said elongate body on each of a plurality of different display systems.

13. The combination of claim 12 in which said retainer is configured for movement of said wheels over said retainer for removing said wheels from said elongate body.

14. The combination of claim 12, and further comprising a second retainer spaced from the first-mentioned retainer for retaining said wheels on said elongate body.

15. The combination of claim 12, and further comprising a loop positioned at one of said opposed ends, said loop being mountable to at least one of said display systems.

16. The combination of claim 12 in which said base portion includes at least one leg portion configured for supporting said elongate body on a surface of at least one of said display systems.

17. The combination of claim 12 in which said base portion includes a pair of leg portions configured for releasably mounting said base portion to at least one of said display systems.

18. The combination of claim 12 in which said elongate body includes at least one outward extending projection positioned to engage at least one of said wheels when said wheels are positioned on said elongate body.

19. A wheel retaining device for storing a plurality of replacement wheels each having an aperture formed therein, said wheel retaining device comprising:

an elongate body insertable through said apertures in said wheels, said elongate body having opposed ends;

a retainer positioned at one of said opposed ends of said elongate body for retaining said wheels on said elongate body, said retainer being integral with said elongate body and configured to permit said wheels to slip over said retainer when said wheels are moved onto said elongate body; and a base portion positioned at the other of said ends, said base portion being configured for selectively supporting said elongate body on each of a plurality of different display systems; and a loop positioned at one of said opposed ends, said loop being mountable to at least one of said display systems, said loop being spaced from said base portion, and said base portion including a lower edge positionable on a support surface and a connector spaced upwardly from said lower edge, said connector being shaped to engage said loop of a second wheel retaining device to couple said second wheel retaining device to the first-mentioned wheel retaining device.

20. A wheel retaining device for storing a plurality of replacement wheels each having an aperture formed therein, said wheel retaining device comprising:

an elongate body insertable through said apertures in said wheels, said elongate body having opposed ends;

a retainer positioned at one of said opposed ends of said elongate body for retaining said wheels on said elongate body, said retainer being integral with said elongate body and configured to permit said wheels to slip over said retainer when said wheels are moved onto said elongate body; and a base portion positioned at the other of said ends, said base portion being configured for selectively supporting said elongate, body on each of a plurality of different display systems, said base portion including at least one leg portion configured for supporting said elongate body on a horizontally extending support surface, said leg portion being further configured for mounting said elongate body to a first display system, said base portion further including a connector spaced upwardly from said leg portion, said connector being configured to mount said elongate body to a second display system different from said first display system.

* * * * *